United States Patent [19]

Hagenburger et al.

[11] Patent Number: 4,776,502

[45] Date of Patent: Oct. 11, 1988

[54] CERAMIC SPOUT

[75] Inventors: Klaus Hagenburger, Carlsberg; Ernst Muller, Wattenheim; Werner Schattner, Hettenleidelheim; Hans G. Rosenstock; Peter W. Valentin, both of Volklingen, all of Fed. Rep. of Germany

[73] Assignee: Chamotte- und Tonwerk Kurt Hagenburger, Fed. Rep. of Germany

[21] Appl. No.: 845,876

[22] PCT Filed: May 31, 1985

[86] PCT No.: PCT/DE85/00187

§ 371 Date: Mar. 27, 1986

§ 102(e) Date: Mar. 27, 1986

[87] PCT Pub. No.: WO85/05584

PCT Pub. Date: Dec. 19, 1985

[30] Foreign Application Priority Data

Jun. 5, 1984 [DE] Fed. Rep. of Germany ..... 3420835

[51] Int. Cl.[4] ..... B22D 41/08

[52] U.S. Cl. ..... 222/606; 222/591; 164/337

[58] Field of Search ..... 222/606, 607, 591, 603; 164/337, 603; 266/285

[56] References Cited

U.S. PATENT DOCUMENTS

| | | | |
|---|---|---|---|
| 3,028,642 | 4/1962 | Stauffer | 222/602 |
| 3,468,526 | 9/1969 | Martinet et al. | 266/285 |
| 3,616,108 | 10/1971 | Whitehouse et al. | 266/285 X |
| 4,108,339 | 8/1978 | Lunde | 222/591 |
| 4,268,015 | 5/1981 | Lührsen et al. | 266/285 X |
| 4,401,243 | 8/1983 | Diederich et al. | 222/591 |
| 4,566,614 | 1/1986 | Frykendahl | 222/591 X |
| 4,640,447 | 2/1987 | Geller et al. | 222/607 X |

FOREIGN PATENT DOCUMENTS

| | | | |
|---|---|---|---|
| 7368 | 1/1982 | Japan | 222/591 |
| 456677 | 2/1975 | U.S.S.R. | 222/591 |
| 444603 | 6/1975 | U.S.S.R. | 222/591 |
| 1260555 | 1/1972 | United Kingdom . | |

*Primary Examiner*—Joseph J. Rolla
*Assistant Examiner*—Nils E. Pedersen
*Attorney, Agent, or Firm*—John F. A. Earley; John F. A. Earley, III

[57] ABSTRACT

During ceramic casting for the production of a molten bath it is often observed that the fire-resistant material becomes eroded and/or solid oxide phases are deposited. Both phenomena interfere with the smooth outflow of the molten bath. The present invention is intended, therefore, to provide an outflow which is stable in shape even when a molten bath is passed through, especially in multiple-sequence casting. To this end, the invention provides for ceramic casting with an envelope (10, 14) which is at least partly external and an internal insert (11, 14, 53) at a distance from the envelope (10, 14), the insert ( b 11, 14, 53) and envelope being connected together.

30 Claims, 9 Drawing Sheets

CERAMIC SPOUT

DESCRIPTION

Figure 1:
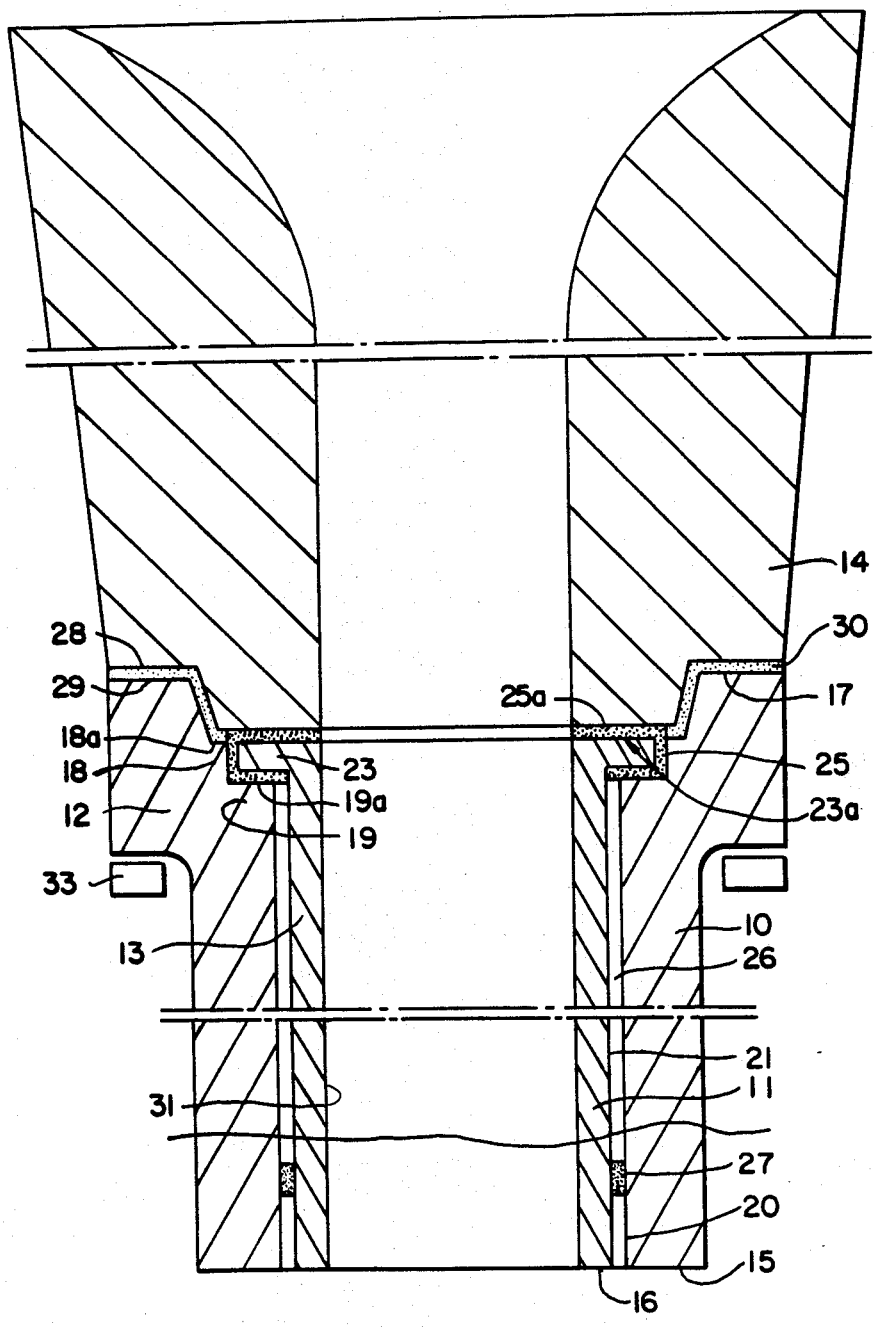
Figure 2:
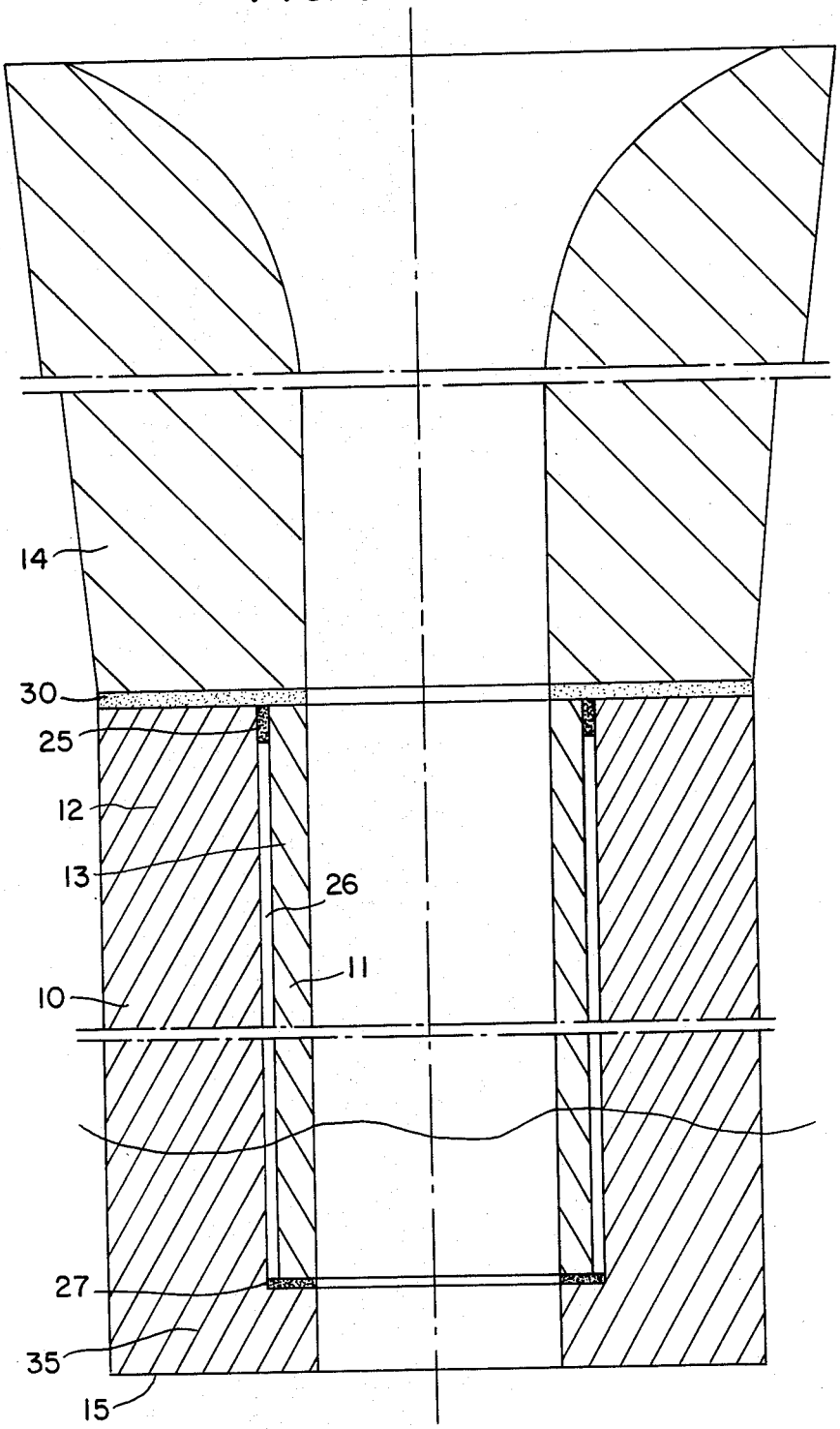
Figure 3:
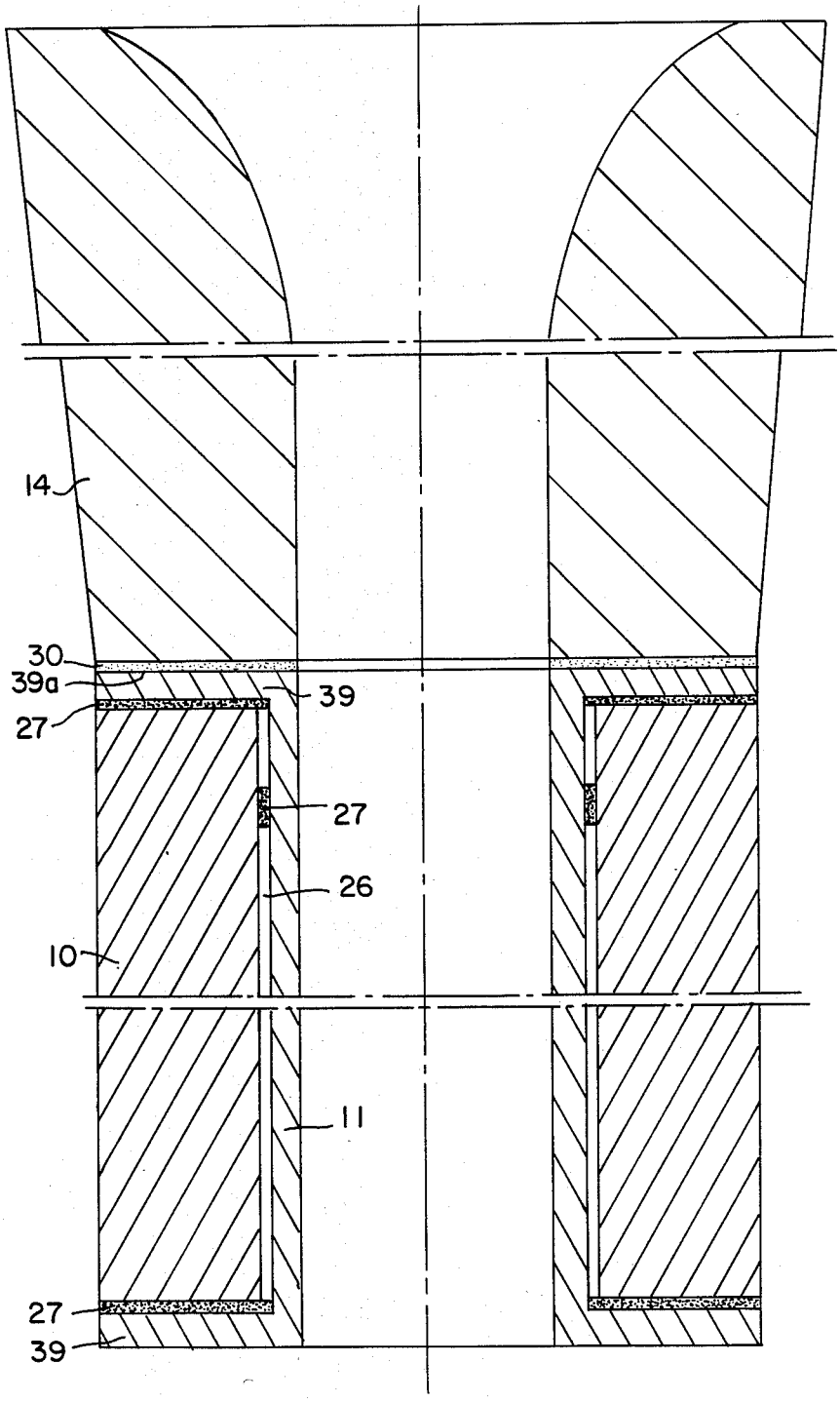
Figure 4:
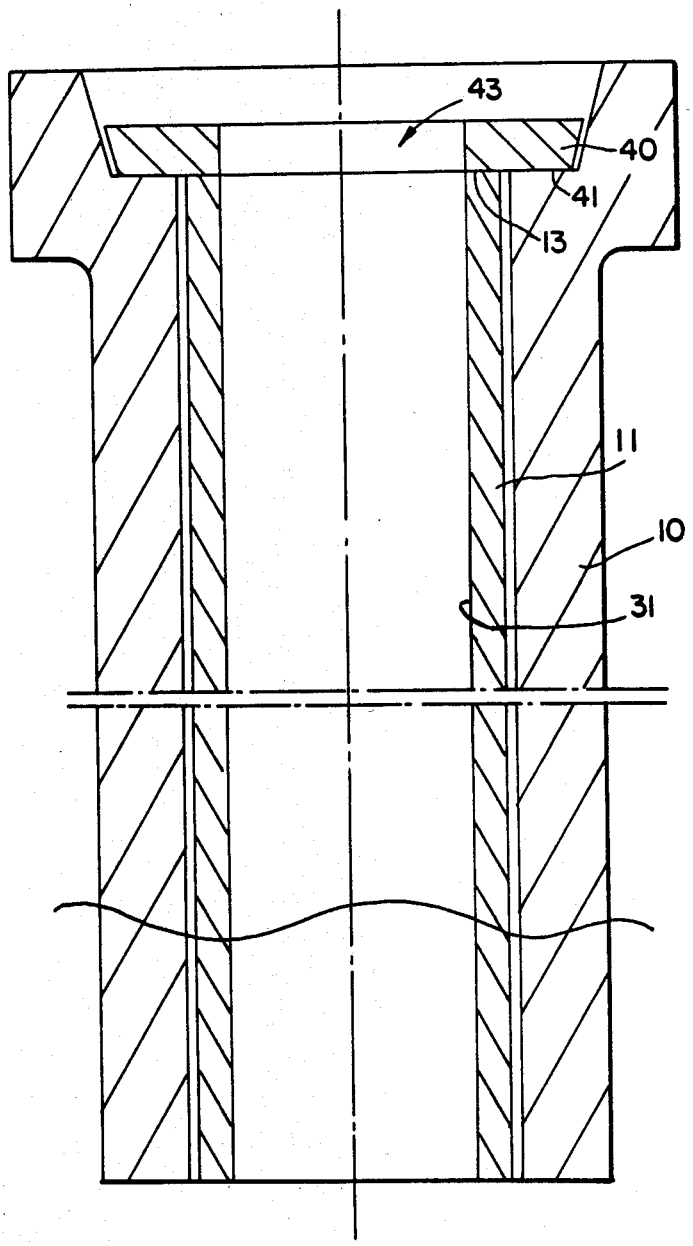
Figure 5A:
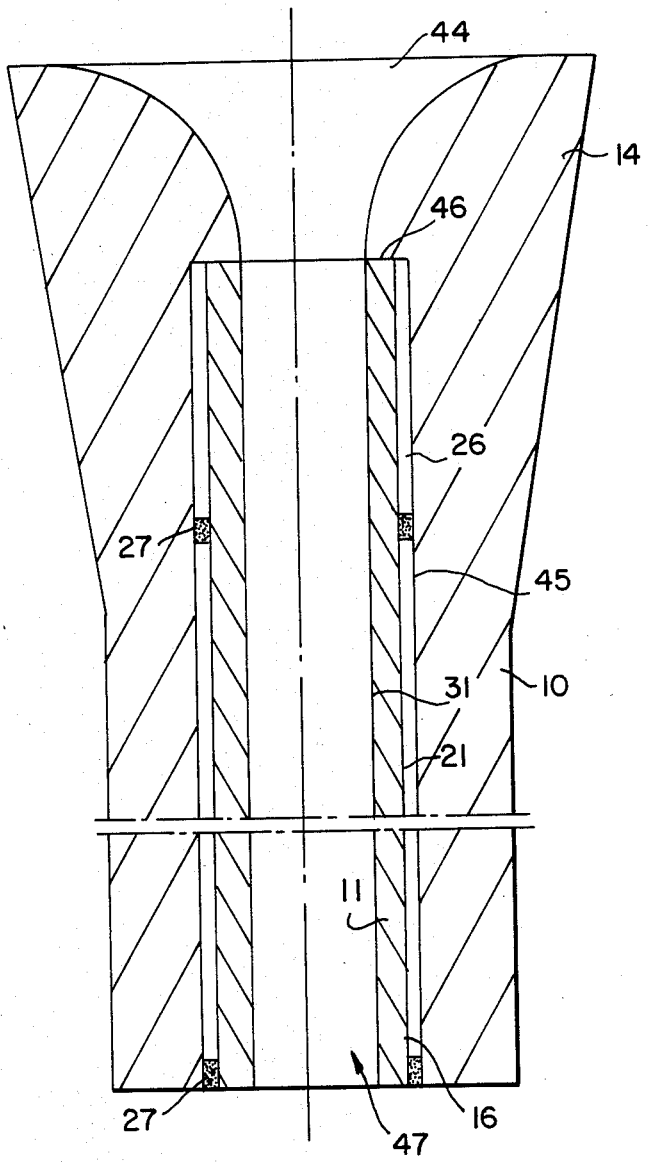
Figure 5B:
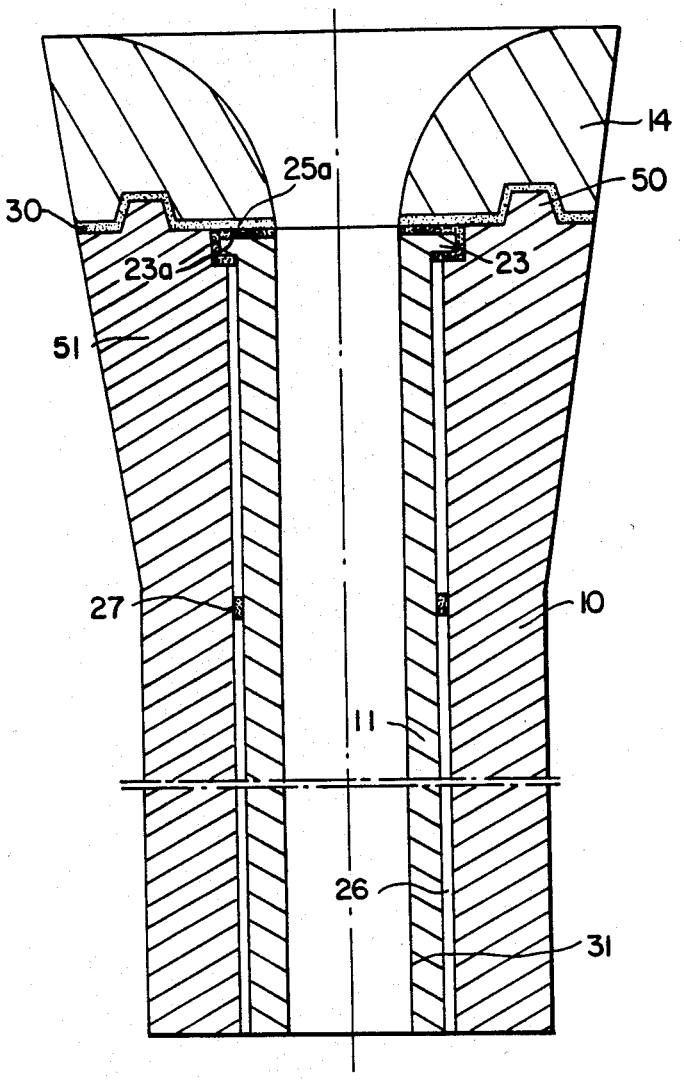
Figure 5C:
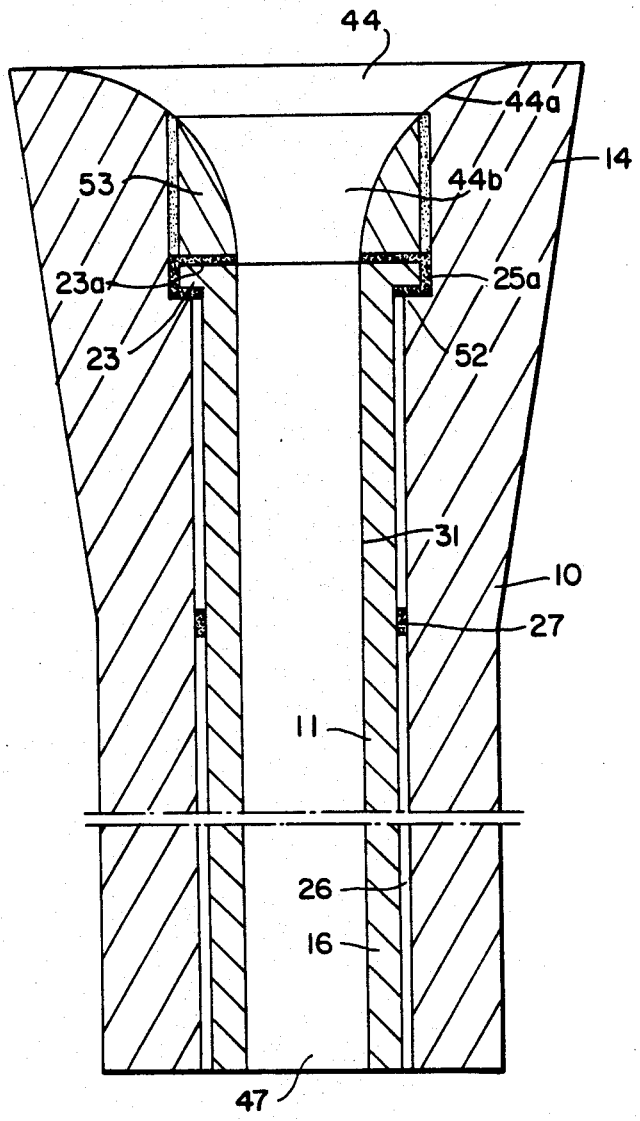
Figure 6:
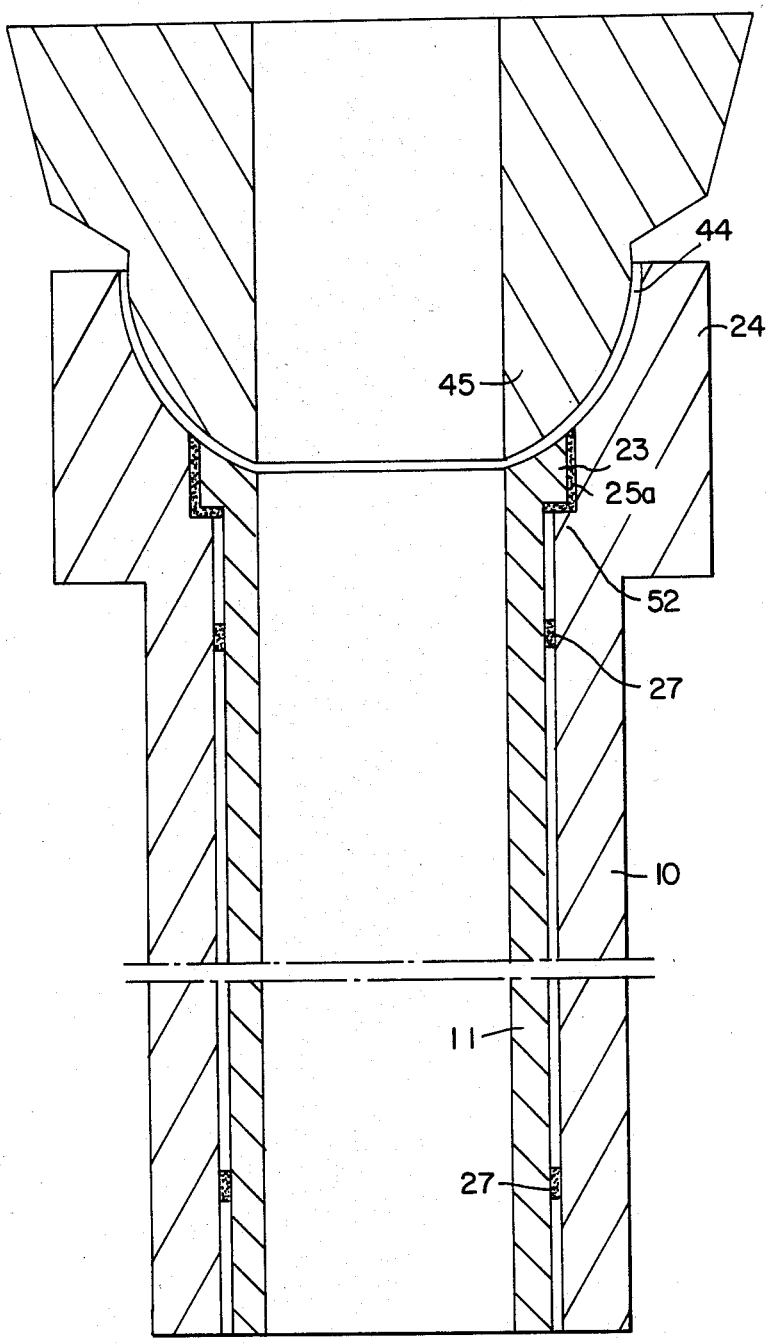
Figure 7:
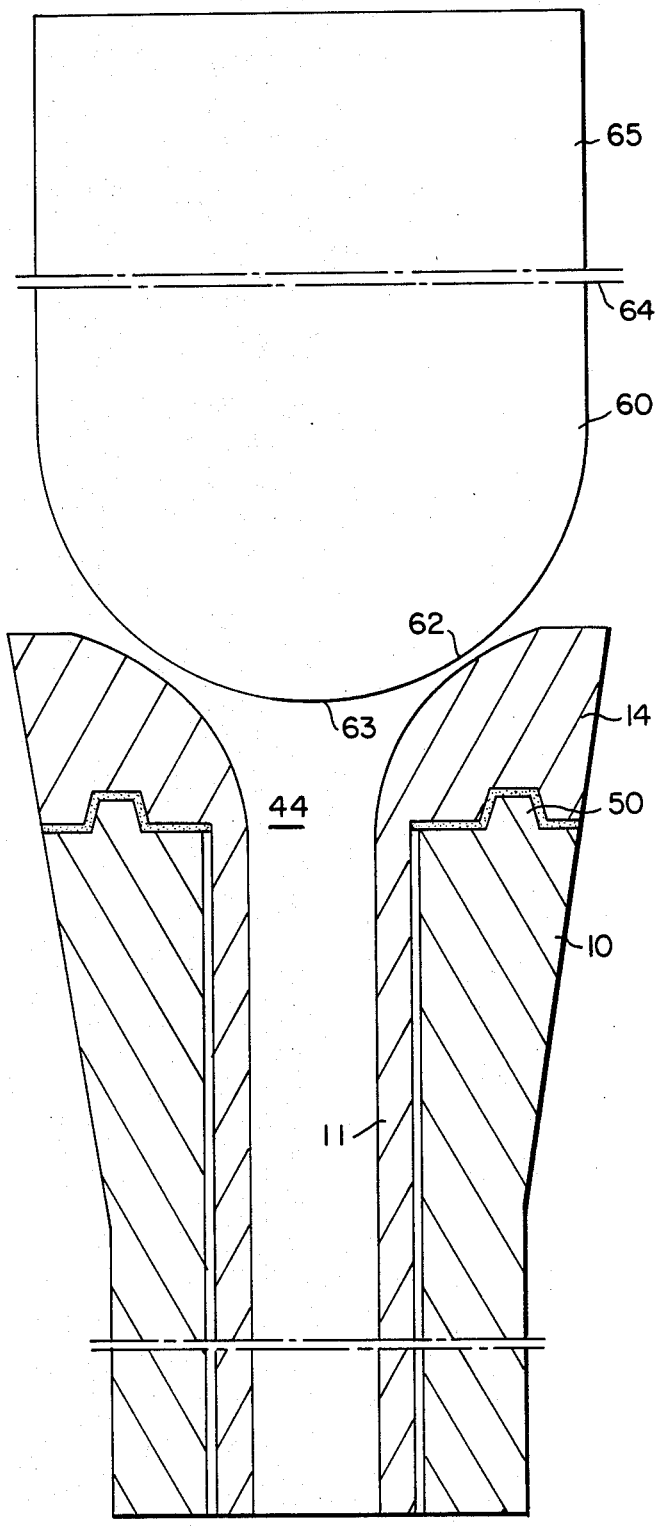

The invention concerns a ceramic spout for the casting of metal melt.

Such a spout with a casing unaffected by changes of temperature and an inner inset made of erosion resistant, fireproof material has been known from the No. DE-A 21 65 537. The spout which is described there is used for the casting of metal melt from the intermediate receptacle (tundish) of an extrusion device into a casting drill. The thought underlying the invention and described in the German publication was based on the idea to offer a spout which would not be subject to an expansion in diameters of the spout. Such an expansion would otherwise have the following disadvantages: it would change the casting speed more or less uncontrollably, moreover the wear and tear at the outer edge of the spout would cause the casting stream to "flutter" and there would be the further disadvantage of an undesirable enlargement of the surface layer, which encourages $O_2$ absorption. According to the No. DE-A-21 65 537 the casing consists of inexpensive, fireproof material, for example fire clay, while the more wear and tear resistant cylinders are to be made of zirconium oxide and materials high in alumina.

But when subjected to continuous casting of steel, such spout systems show substantial disadvantages.

As described in the essay by Hauck et al. (Arch. Metallurgy of Iron 53 (1982) 127ff) immersion spouts made of fire clay, graphite, silicondioxide and silicon carbide will show deposits on the inner surface of the spout material after a certain periodd of casting. These lead to a narrowing in the diameter of the immersion spout used for the casting practice, thus causing a continuous reduction of the amount that can be casted within a given period of time.

The same observations are made with immersion pipes designed with two components, as described in the No. DE-A-21 65 537.

The practice of adding Ca or CaSi alloys to the fluid steel has been described in the No. DE-A-27 31 367, which prevents the deposits on the surface of the immersion spout material, as described above. This elaborate procedure is cumbersome, though, and the aim, namely the prevention of the formation of deposits altogether, is not always achieved.

The invention is based on the task to suggest a ceramic spout, i.e. a casting device, through which metal melt can be conducted and which prevents erosions of the fireproof material and/or a deposit formation of hard, oxide phases. The spout, i.e. the entire casting device, is not only to be sufficiently wear and tear proof for the use in multiple sequence castings but also easily produceable and insertable.

For this purpose the invention intends a ceramic spout for the casting of a metal melt with an at least partial casing made of a material unaffected by changes of temperature and an inner inset made of erosion resistant, fireproof material, with casing and inset being arranged at a distance from one another and with the distance of the surfaces of the casing and the inset, which border on this space on two sides, bigger than or identical to the maximum thermal expansion of the corresponding materials of casing and inset during the actual employment. Preferably the space between the inner wall of the casing and the outer wall of the inset is at least partially filled with one or more materials which are combustible under volume reduction, when temperatures are below those which can be achieved in this space. By leaving a gap between the casing and the inset, i.e. by creating a space between the two parts, one takes into account the different thermal parameters of the employed fireproof materials, especially the various thermal expansions of the fireproof materials of the casing, and of the inset.

Thus, by chosing a fireproof material with higher thermal expansion for the inset, for example, mechanical tensions in the inset, i.e. contact joints, contact surfaces, between casing and inset can be avoided, since the inset material can freely expand and fill the space between the casing and the inset continuously. In order for the inset to be positioned optimally in the casing during the assembly and the casting process, the invention intends for the space between the inner wall of the casing and the outer wall of the inset to be at least partially filled with a material. This material is to fulfill the requirement to be combustible, at temperatures below those that can be achieved in this area. The term combustible, in the invention, refers to any kind of change of state under reduction of volume, so that for example gasifiable, cokeable, evaporable or volatilizeable materials can be employed. This allows for the fireproof materials to freely expand after the beginning of the casting process, since the fill material burns out simultaneously. The fill material does thus not represent a mechanical resistance factor any more and tension, which would jeopardize the strength, can be avoided.

Therefore an advantageous further development of the invention intends for the material to be a largely residual-free, combustible material, preferably a material, which burns free of ashes—particularly those ash-free materials with an ash content of less than 0.5% of the original weight. Fireproof wool may also be used, because it is easily compressable, especially if it is rich in $Al_2O_3$— or $SiO_2$—.

In this case in particular the entire space volume between the casing and the inset is available for the expansion of the fireproof materials after the combustion and the essentially ash-free combustion process furthermore prevents punctiform or laminar zones in this described space, which could possibly hinder the expansion of the fireproof materials. It is particularly advantageous, if the distance between the outer wall of the inset and inner wall of the casing as well as their wall thicknesses are identical over the entire spout region. Under those circumstances the advantageous effects, as described above, of the fill material, which burns ash-free, can particularly be utilized. An even distance between inset and casing is thus guaranteed during the installation of the spout as well as during the casting process. This not only improves the homogeneousness of the thermal conditions in the spout region and thus the casting conditions but can possibly also eliminate thermal tensions, which can damage the inset or the casing.

Under the invention, the distance of those surfaces of the casing, and of the inset, which border on two sides of the inner space can be bigger than or identical to the maximum thermal expansion of the corresponding materials. In the first case there remains a gap between casing and inset even under maximum temperature exertion, while under the latter variant the outer wall of the inset touches the inner wall of the casing in case of extreme thermal expansion. It is then not only advantageous to use a fill material which burns without ash formation but also to have corresponding surfaces of the inset and the casing which are as smooth as possible, to avoid tension caused by uneven surface apposition. It is preferable for the inset to be stabilized in its position by the fill material in the casing. Under the invention the rubric term "ceramic spout" refers to every spout which can be used for the conduction of metal melt. An immersion spout for continous casting devices may be mentioned here as an example. The so-called blind rod between the casting ladle and the immersion vessel as well as the simple immersion rod and finally also the influx element, which is attached to the intermediate vessel, can be designed in the same fashion described in the invention. Furthermore the influx element andthe immersion rod can be designed as one prefabricated component, which is at least partially surrounded by the casing. Insofar the term "ceramic spout" refers to individual components and random combinations of components of these spouts.

There are different versions for the positioning of the inset in the casing, according to the invention.

In different applicational areas it can suffice to use the static friction between fill material and casing to maintain the position of the aligned inset in the casing.

It is nevertheless preferable to apply special measures to insure the stability of the inset in the casing. The inset can for example be connected to the casing by way of one or several support and/or suspension elements. These can be positioned as inlet flanges at the end of the inset, or of the casing, and they can be interlocked with, i.e. superimposed onto, the suitable receptacles of the corresponding parts of the spout.

A favorable version of the invention intends for the inset to be equipped with an outer flange at the end, with which it is suspended in the casing. Such a version will particularly avail itself to rod-shaped spouts (immersion spouts).

But casing and/or inset can also be cone-shaped and narrow at the bottom, thus creating an automatic lead for the inset in the casing.

An alternative version intends for the casing to be longitudinally divided and to surround the inset, which is equipped with an outer flange on the two free end surface.

The erosion resistant, fireproof material of the inset is preferably chosen from among those fireproof products, the free Gibbs enthalpy of which shows a high negative value during the chemical formation reaction, so that stable compounds are available. Among those count CaO, MgO, BeO and $ZrO_2$, but also tar-soaked, fireproof products, which prevent oxidizing; bakelite-bonded materials may also be used, preferably those, which during the process turn into a solid carbon compound.

Simple and inexpensive fireproof grades, such as fire-clay, alumina graphite, amorphous silica, mullite, mullite-graphite or zirconium silicate can be used as material for the casing. But if the casing forms one prefabricated component with other parts of the spout, which come indirect contact with the metal melt, then the casing should also be made of those materials, which are mentioned above for the inset.

Different paper and cardboard grades can be used as fill material just as well as plastics, which burn largely free of residue. Porous and foamed materials are preferable, which on one hand assure a perfect fit of the inset into the casing but on the other hand, due to their low content of solid matter, have lower ash contents, such as: foamed plastics, epoxy resin, etc.

Moreover formaldehyde resins, for example, or different waxes may be employed.

Within the scope of the invention it can also be advantageous, as shall be illustrated with the help of the illustration, to use different materials next to or on top of each other.

In an advantageous version of the invention it is intended for the fill material to be produced as a prefabricated component, for example in ring or cartridge shape, and to be glued, pushed, affixed or stuck onto the inset before the inset and the casing are connected.

It has proven particularly advantageous with this spout connected to an intermediate vessel (tundish), to design the influx element (in the following illustration with the reference no. 14) according to the invention and, particularly, to also equip it with an inset and a casing. It is also possible to then design the inset of the influx element and the inset of the immersion rod in one piece. With this design it is especially desirable, if the common inset of this "mono-immersion-spout" is made of magnesite. This shape presents the additionnal advantage that there are no more cumbersome joints or connections in the area through which the metal melt is conducted.

In order to further avoid the described problems, namely the erosions and/or deposit formation of solid, oxide phases, the invention furthermore suggests a spout-plug-combination with a spout as described under the invention, fitted with a suitable plug. At least that surface of the plug, which comes in direct contact with the spout, should be made of the same material as the spout in the corresponding influx area, consequently preferably of the work materials mentioned above: CaO, MgO, $ZrO_2$ or BeO. The plug can either have a surface layer with such a coating but on the other hand the plug head in its entirety can also be made of this material, while the upper portion of the plug consists of conventional, fireproof grades, such as an alumina-graphite. But the whole plug, inclusive of the plug head, can also be made of this fireproof material. If the form is divided and made of different materials, the two components can be glued or screwed together. It is also possible to sinter both elements to one another.

Finally the invention also suggests to design the plug at least as far as the part is concerned, which comes in direct contact with the spout, in the same fashion as the spout in this invention. The plug is thus supposed to consist of a casing made of erosion-resistant material and, on the inside at a distance, of an inset made of material, which is unaffected by changes of temperature. The advantages, listed for the spout, then also apply to the plug.

It has surprisingly be ascertained that this very combination of a spout, under the invention, with a special plug further reduces the deposit formation and/or the erosion (occurances, which are also influenced by the metal grade chosen).

What follows is a detailed description of the invention with the help of the illustrations:

Illustration 1 shows: a ceramic spout, under the invention, as immersion spout for continous casting devices, longitudinal section.

Illustration 2 shows: another version of an immersion spout, according to ill. 1.

Illustration 3 shows: a third version of an immersion spout.

Illustration 4 shows: another version of an immersion spout, according to ill. 1. longitudinal section)

Illustrations 5*a, b, c* show: three other versions of a spout under the invention, longitudinal section Illustration 6 shows: a spout under the invention with a ball end influx element Illustration 7 shows: a spout-plug-combination under the invention with a mono-immersion-spout and a suitable plug, schematic presentation, longitudinal section.

The immersion spout in illustration 1 consists of an outer, cylinder-shaped casing 10 and an inset 11, also cylinder-shaped, arranged therein.

With their upper free ends 12, or 13, the casing 10, or the inset 11, are turned towards the influx element 14 of the intermediate piece (tundish), while the upper, free end sections 15, or 16, are turned towards the iron mold, arranged beneath.

The upper, free end of the casing 10 is designed in an outwardly angled, graded shape and apart from the apposition layer at the end 17, two other separate grades 18, 19 are intended with two apposition layers **18*a*, 19*a*, which basically extend perpendicularly to the longitudinal extension of the casing 10. Except for the graded upper end 12, the remaining portion of the casing 10** is cylinder-shaped with invariable wall thickness along its entire length.

It can be advantageous from the point of view of the manufacture to design one or more outer layers slightly cone-shaped to be able to more easily remove the casing from the tool.

The inset 11 of the immersion spout is positioned on top of, i.e., suspended from, the support layer **19*a*, which is formed by grade 19 of the casing 10. For this purpose the upper, free end 13 of the inset 11 is equipped with an outwardly directed ring flange 23. The breadth of the ring flange 23 is chosen so that the outer surface 21 of the inset 11, after its suspension from the casing 10, then maintains everywhere the same distance from the inner surface 20 of the casing 10. For this purpose a material 25 is filled into the space between casing 10 and inset 11 in the region of the grade 19. This material is combustible, at temperatures below those which can be achieved in this area. A light, compressible, fireproof cotton can also be used as material 25**.

A similar strip of material **25*a* is also superimposed onto the ends of the support layer 23*a* of the ring flange 23**, which will be described in greater detail later on.

In order to further optimize the positioning of the inset 11 in the casing 10 that is in order to guarantee that along the entire length of the inset 11 a constant distance towards the casing 10 is maintained, one can—and this should preferably be done in the lower area of the space 23, which is turned towards the iron mold—insert an additional strip of material 27, to fill the space between the casing 10 and the inset 11.

In an advantageous version of the invention it is intended for the strip of material **25*a* in the area of the flange 23 as well as the strip of material 27 in the lower area of the space 26 to be inserted onto the inset 11 before the inset 11 and the casing 10** are put in place, which simplifies the assembly of the entire immersion spout.

With their lower, free ends 15 or 16, the casing 10 and the inset 11, extend into the iron mold; the level of the steel melt is indicated with a wavey line.

A (not shown) variable is designed to reinforce the lower part of the casing 10, which is immersed into the steel melt, with a fireproof material on the outside, such as zirconium oxide, to prevent erosions, especially in the contact area: casing-casting powder.

The casing 10 as well as the inset 11 are made of fireproof materials. While for example fire-clay grades, alumina-graphite mixes or amorphous silica are used for the casing besides zirconium silicate or mullite the erosion and corrosion resistant, fireproof material is preferably chosen from the group of materials, the Gibbs enthalpy of which shows the highest negative value possible during the chemical formation reaction. These materials have proven effective in respect to their erosion resistance and the prevention of deposit formation, since the compounds are very stable. Apart from $MgO—ZrO_2$ and BeO or CaO for example are suitable materials. As solids, these materials possess a high surface tension, which may also be partially responsible for the good performance during the casting process.

The thermal expansion of the applied materials can easily be ascertained in tests, in order to then be able to determine the necessary gap width for the space 26. This is essential to assure that even under maximum thermal expansion of the inset and casing material, the outer wall 21 of the inset 11 is not pressed against the inner wall 20 of the casing 10, thus, tension problems in this area can successfully be avoided.

The gap width of the space 26 is preferably chosen in such a fashion that even under maximum heat expansion in this area, a residual gap remains between inset 11 and casing 10. Ash-free burning substances are desirable as fill material 25,27, such as paper and cardboard grades, poly-vinyl chloride, formaldehyde resins or waxes, which burn largely free of residue.

The immersion spout is attached to the tundish spout, which forms the influx element. It is positioned on locking pins 33 below the graded end 12 and moreover connected to the influx element 14 by way of fireproof putty 30. For this purpose, the lower, free end of the influx element 14 has correspondingly in the shape of the immersion spout a graded design. Between the corresponding contact surfaces 29,28 of the immersion spout and of the influx element 14, the fireproof putty 30 is filled, except for the area above the ring flange 23 of the inset 11, in which, as described, the combustible material is inserted. The layers of material **25,25*a* between inset 11 and casing 10 assure the unhindered moveability of those against each other. The use of plastic putty is more favorable, since it possesses good adhesive qualities. The putty 30** allows for an airtight bond between the immersion rod and the influx element.

The putty tends to harden during the preheating process of the device as a whole, which then leads to the particularly advantageous reactions of a spout, described in this invention.

During and after the hardening of the putty 30, the inset 11 could not expand freely any more, if the space 26 between inset 11 and casing 10, or the special retention at the influx element 14, had not been intended.

After the hardening of the putty 30, the inset 11 can now expand in the direction of the casing 10, or in the direction of the iron mold; thus the space 26 becomes continuously smaller. At the same time, the fill material **25, 25*a*, 27 burns out, because of the temperatures that prevail during the pre-heating process. This fact enables an unencumbered expansion of the inset and casing material. In the area beyond the influx element 14, the layer of material 25***a* also insures a free expansion of the ring flange 23 in the direction of the influx element 14 and perpendicularly thereto.

Depending on the pre-determined gap width of the space 26, it is at least very desirable, if the fill material 25,37 burns largely without residue in order to avoid punctiform or laminar arching in space 26.

In order to keep the gap width of space 26 constant over the entire surface of the immersion spout and to keep the working surface for the metal melt, which is cast along the inner wall 31 of the inset 11 as limited as possible, the walls 21,31 of the inset 11 and the inner wall 20 of the casing 10 possess a very high surface finish. This can be achieved in different manufacturing processess.

The structural components can for example be produced with the "wet matrix technique". In this process, a rubber form is filled with each powder, sealed and then pressurized in a container filled with a certain fluid (for example oil or an oil-water mix). Since the rubber form is on all sides surrounded by the pressure fluid, the compression takes place evenly, the produced pressure extends evenly in all directions. The powder is pressed onto centrally arranged metal spikes, which mark the inner passage of the pipe. During the compression process the powders are subject to a reduction volume, which differs depending on the properties of the materials and granules but which can be calculated in advance.

Components produced in accordance with this procedure fulfill the required criteria. Punctiform or laminar contact areas between inset 11 and casing 10 will not occur. The surfaces 20,21,31 should preferably be as smooth as those of the metal surfaces after a chipping and roughing treatment. There are no limits to the fineness of the surface finish.

The structural components can also be produced by pressing a flexible inner form onto a rigid outer form, with pressure exerted from the inside to the outside.

Another version intends for the casting openings of the structural components 10,11 for the metal melt to be obtained by way of drilling through pigs.

Tests have shown that the arrangement according to the invention offers another advantage. By creating a distance (space 26) between inset 11 and casing 10 and/or by the use of a thermal insulation material as fill material in this space 26, leakage of heat to the surrounding area is greatly reduced when casting the hot metal melt, which improves the working conditions for the service personnel. Because of the insulation effect, a reaction possibility of the fireproof material with the casting powder, which has been superimposed onto the steel solution of the iron mold, is also reduced.

By using an immersion spout as shown in illustration 1 of the invention, not only the undesirable deposit formation can be prevented but such an immersion spout also enables casting with high ladle sequence.

In the same fashion as described above with the immersion spout, the tundish spout (influx element 14) can, under the invention, also be constructed of an inner inset and a casing. As far as the employed materials and the advantages arising from such an arrangement are concerned, the same facts apply, which have been described above in the context of structural elements 10 and 11.

The version depicted in illustration 2 is another presentation of an immersion spout, under the invention, consisting of different components and materials. But the lower end 15 of the casing 10 has an inner flange 35 on which the inset 11 rests. Similarly, as also described in the context of the versions in illustration 1, the area between flange 35 and the lower, free endd of the inset 11 is wedged with a fill material 27, as described in the invention so that after heating the device, the fireproof material can freely expand in every direction, since the fill material simultaneously burns out.

The upper, free ends 12,13 of the casing 10 and of the inset 11, are again glued to the influx element 14 with a fireproof putty 30.

In order for the plastic putty 30 not to penetrate the space 26, the space 26 is filled again at its upper end with the fill material 25 of the invention. This material can here be pushed as prefabricated ring over the inset 11, which very much simplifies handling and assembly of the device.

The version in illustration 3 is different from those described so far, particularly in that the casing 10 is longitudinally divided. This is necessary in this case, since the inset 11 is equipped on both sides with outer flanges 39, constructed in one piece. Consequently the casing 10 can no longer be slipped onto the inset 11, but must be attached to the sides.

Between the flange ridges of the flange 39 and the casing 11, fill material 27, as described in the invention, was inserted again.

The influx element 14 is again glued with a fireproof putty 30 against the outer surface 39*a* of the ring flange 39. It can moreover, just like the immersion spout, be designed with a wider casing.

In illustration 4, the casing 10 and the inset 11 have been joined by way of a little plate 40, inserted between the two.

While the basic structure of the casing corresponds to the one described in the version in illustration 1, the inset differs from the one in ill. 1 in so far as this one is designed in the form of a simple pipe without end flange.

On its upper, free end 13, the inset 11 with its end plate is glued against the lower surface of the little plate 40. The little plate 40 lies moreover on the contact surface formed by the grade 41 of the casing 10 and is glued to this. The measurements of the ring-shaped little plate 40 have been chosen in such a way that it fits perfectly onto the grade 41 and that the inner surface of its middle drilling 43 aligns with the inner surface 31 of the inset 11.

The little plate can for example be made of graphite. The other contact surfaces between the little plate 40 and the casing 10 can be sealed with a fireproof putty. The influx element is installed on top, as shown in ill. 1.

In illustrations 5*a–c*, one spout each is depicted, with the casing of an immersion pipe integrally one with the influx element 14: in respect to the structure (ill. 5*a, c*) and/or in respect to the material (ill. 5*a–c*).

In illustration 5*a* the influx element 14 is constructed as one with the casing 10, with casing 10 and inset 11 ending on the same level with their lower ends. The number of structural components in this version can be reduced from 3 to 2.

In the area of the port slot 44, the influx element 14 is designed funnel-shaped and convexly arched for the metal melt. At the lower end of the funnel-shaped part, the influx element 14 is designed on its inner wall with a ricochet 46, which, at its lower, free end is succeeded by a cylinder-shaped recess 47.

In the recess 47 rests the inset 11, the cylinder shape and wall strength of which is more narrow than the breadth of the ricochet 46. The inner diameter of the inset 11 corresponds to the inner diameter of the port slot 44 on its lower end, so that the inset 11 can be inserted into the recess 47 in such a fashion that its inner wall 31 aligns with the lower wall section of the port slot 44 in the area of the ricochet 46 and the space 26, as described in the previous illustrations, remains between the outer wall 21 of the inset 11 and the inner wall 45 of the casing 10.

In the area of the ricochet 46, the inset 11 is glued with a fireproof putty to the influx element 14 and in the area of the space 26, two ring-shaped strips 27 made of the described, combustible material are installed at a distance from one another, to maintain the gap. Preferably these strips are given made of prefabricated rings and can be pushed onto the inset 11, so that the inset 11 together with the strips of material 27 must during the assembly of the spout only be inserted from the bottom onto the casing 10 and then be glued with the upper front surface against the ricochet 46. Since casing 10 and influx element 14 are one piece and since the influx element 14 comes in direct contact with the fluid metal melt, the entire spout part should preferably be made of an erosion resistant and fireproof material. The invention suggests the use of those materials—if possible—which are also recommended for the inset 11.

In the example in illustration **5*b*, the inset 11, similar to ill. 1, is suspended in the casing 11 with the help of a ring flange 23** from the upper ends.

The lower part 10 largely corresponds to the casing in illustrations 1 through 4, with a groove-and-torque joint 50 at the level of the contact surface **23*a* of the ring flange 23 making it possible to join the casing 10 and the influx element 14** together.

Contrary to the versions in illustrations 1 through 4, the structural components 10,14 here are made of the same material, for example magnesium oxide or a similar erosion resistant and fireproof material.

The casing 10 of the spout has at its upper end 12 a grade 51 on that side on which, as shown in ill. 1, the inset 11 rests on the ring flange. The rest of the design largely corresponds to the one depicted in ills. 1 through **5*a***. The operation and reaction of the individual structural elements does also correspond to those described in the context of the above-mentioned illustrations.

AlternativeLy to version **5*b*, a version as represented in ill. 5*c* suggests itself for the spout with an inset 11 and flanges on both sides. In this case, the influx element 14 is again, like in ill. 5*a*, designed in one piece with the casing 10, around the inset 11. But in order to be able to connect the inset 11 with the influx element 14, the area of the port slot 44 is designed funnel-shaped, but the inner surface is not or only partially convexly arched. A slightly convexly arched part, which runs along the upper rim 44*a*, is followed by a cylinder-shaped section 44*b* of the port slot 44, which extends in the direction of the lower, free end 16 of the inset 11, down into the area of the grade 52, which runs inward. From its lower grade end, another cylinder-shaped recess 47 extends downward. The diameter of the cylinder-shaped recess 47 is smaller than that of the cylinder-shaped section 44*b* of the port slot 44. In the same fashion described in illustrations 1 and 5*b*, the inset 11 is again suspended in the influx element or the casing, with a ring flange 23 and can, during assembly, be inserted from the top through the port slot 44. The inset 11 is designed in such a fashion that the outer diameter of the ring flange 23 is chosen a little bit smaller than the diameter of the lower part 44*b* of the port slot 44**.

In the area of the grade 52, a strip **25*a* of combustible material has been inserted again. Such a strip 27 is also around the inset 11 at a distance from the ring flange 23 and fills the space 26 between inset 11 and casing 10**.

An inset 53 extends from the upper frontal area **23*a* of the ring flange 23. The inset 53 has a shape which—after the installation—gives the upper portion of the influx element 14 an appearance as illustrated in ill. 5*b*. For this purpose, the inset 53 has a cylinder shape with a slightly smaller diameter than the port slot 44*b*, while the inner part as extension of the convex arch of the port slot 44 is also convexly arched and at its lower end is aligned with the inner wall 31 of the inset 11**.

The inset 53 can be glued into the influx element 14 with the putty 30. The inset 53 is preferably produced from the same material as the inset 11, which the influx element 14 and the attached casing 10 also consist of.

The spout depicted in ill. 6 shows a ball end upper portion with an immersion pipe connected to the end and therefore carries its name. The spout largely corresponds in its design to the one in ill. **5*c*, namely the inset rests on grade 52** of the casing.

The ring flange 23 of the inset 11 is—in conformity with the upper part 24 of the spout—designed with a concave curvature in the area of the port slot 44, so that the corresponding surfaces of the ball end influx 45 and the ring flange 23, or part 24, run parallel to one another.

Ill. 7 represents a spout according to the invention, namely a so-called "mono-immersion-spout" with the inset 11 constructed inone piece with the influx element 14. To avoid repetition, we refer to the description of ill. **5*b*. The version in ill. 7 differs from this one in that the inset 11 is designed without ring flange 23 and integrally goes over into the influx element 14 (which ends in the tunish receptacle). The casing 10 is analogously arranged around the inset element 11 and joined by way of a groove-and-tongue joint 50 to the influx element 14 with the help of fireproof putty 30**.

In this form the influx element 14 almost represents a part of the inset 11. The casing 10, therefore, can of course—within the scope of the invention—also reach up into the area of the influx element 14 and cover it. The best version usually depends on the various, individual conditions.

In the version in ill. 7 there are no more seams or connective pieces in the area through which the metal melt is cast—which is particularly advantageous.

A plug 60, which in known fashion is positioned above the port slot 44, is part of the spout. The spout-plug-combination, made according to the invention, is characterized by the fact that the surface 62 of the plug, which comes in direct contact with the spout (i.e. the influx region 14) is made of the same material as the spout in the corresponding influx region 14, preferably of CaO, MgO, $ZrO_2$ or BeO.

It has been shown that especially when the spout and the plug are manufactured from the same erosion resistant, fireproof material, the undesirable deposit formation or erosions (depending on the steel grade) can be prevented.

Rather than coat the plug, one can also plan to produce a more or less big area at the end of the plug from the above-mentioned material. The area from the lower vertex 63 up to the broken line 64 in ill. 7 can be made of magnesite. This part is then glued, screwed or with any other method attached to the upper part 65, which can for example be made of alumina graphite. Depending on which materials were used to produce the parts 60,65, both components can also be sintered together.

Other versions of a spout are possible within the scope of the invention idea. The installation part 53 of the spout in ill. 5c may not only be designed as prefabricated structural component, but this area can, for example, be filled with a commercially available spray compound, preferably of the same material as the influx element 14.

We claim:

1. Ceramic spout for the casting of metal melt, with an at least partical casing (10) made of material substantially unaffected by changes of temperature and an inner inset (11) made of erosion resistant, fireproof material, characterized by the fact that (a) casing (10, 14) and inset (11, 14, 53) are separated by a radial gap everywhere between their corresponding surfaces to allow for radial expansion;

(b) the gap is bigger than or identical to the maximum thermal expansion of the materials of the casing (10, 14) and the inset (11, 14, 53) in this area, when the device is in use;

(c) the inset (11, 14, 53) is made of a material, the free Gibbs enthalpy of which has a negative value effectively high enough so that the material is stable; and (d) longitudinal expansion means allowing for unimpeded longitudinal expansion of the casing and substantially the entire length of the inset up to the maximum thermal expansion of the materials of the casing and inset.

2. Spout under claim 1,
characterized by the fact that
the gap (26) between casing (10, 14) and inset (11, 14, 53) is at least partially filled with material (25, 27) which is combustible at temperatures below those obtained in the gap (26) when hot metal melt is passing through the spout so that said material is burned away when hot metal is passed through the spout to provide room for the casing and inset to expand toward each other.

3. Spout under claim 2,
characterized by the fact that the material (25,27) burns largely without residue, preferably ash-free.

4. Spout under one of the claims 2 or 3,
characterized by the fact that the space (26) is at least partially filled with a thermal insulation material (25,27).

5. Spout according to claim 2,
characterized by the fact that the material (25,27) is made of foamed plastic wax.

6. Spout according to claim 2,
characterized by the fact that the material (25,27), inserted onto the inset (11) in the shape of rings, crosspiece flanges, spacers or as cylinders, partially or completely fills the space (26).

7. Spout according to claim 2,
characterized by the fact that the material (25, 27) is made of paper.

8. Spout according to claim 2,
characterized by the fact that the material (25, 27) is made of cardboard.

9. Spout according to claim 2,
characterized by the fact that the material (25, 27) is made of epoxy resin.

10. Spout according to claim 2,
characterized by the fact that the material (25, 27) is made of wax.

11. Spout according to claim 1,
characterized by the fact that the inset (11,14) is connected to the casing (10,14) by way of one or several a support element (23).

12. Spout according to claim 1,
characterized by the fact that the inset (11) is suspended in the casing (10) by a flange (23).

13. Spout according to claim 1 with the inset (11,14,53) and the casing (10,14) produced in an isostatic pressing process.

14. Spout according to claim 1,
characterized by the fact that the casing (10,14) is made of a fireproof, ceramic material, such as: fire-clay, alumina, alumina-graphite, amorphous silica, mullite mulllite-graphite or zirconic silicate.

15. Spout according to claim 1,
characterized by the fact that the inset (11,14,53) is made of CaO.

16. Spout according to claim 1,
characterized by the fact that its structural components (10,11,14,53) were at least partially soaked in tar.

17. Spout according to claim 1,
characterized by the fact that the inset (11,14,53) and the casing (10,14) are made of the same fireproof material.

18. Spout according to claim 1,
characterized by the fact that it is equipped with a suitable plug (60) with at least one surface (62), namely the one, which comes in direct contact with the spout, made of the same material as the spout in the corresponding influx area (14), preferably MgO, $ZrO_2$, BeO or CaO.

19. Spout under claim 18,
characterized by the fact that the plug in its entirety consists of one material.

20. Spout according to claim 1,
characterized by the fact that
the gap (26) between casing (10, 14) and inset (11, 14, 53) is at least partially filled with material (25, 27), which is very compressible under volume reduction, at temperatures below those obtained in the gap (26) when hot metal melt is passing through the spout so that said material is compressed when hot metal is passed through the spout to provide room for the casing and inset to expand toward each other.

21. Spout under claim 1,
characterized by the fact that
the gap (26) between casing (10, 14) and inset (11, 14, 53) is at least partially filled with material (25, 27), which is combustible and very compressible under volume reduction, at temperatures below those obtained in the gap (26) when hot metal melt is passing through the spout so that said material is compressed and burned away when hot metal is passed through the spout to provide room for the casing and inset to expand toward each other.

22. Spout under claim 21,
characterized by the fact that the material (25, 27) burns largely without residue, preferably ash-free.

23. Spout under one of claims 20 or 21, the material (25, 27) being a thermal insulation material (25, 27).

24. Spout according to claim 1,
characterized by the fact that the inset (11, 14) is connected to the casing (10, 14) by way of a suspension element (23).

25. Spout according to claim 1,
characterized by the fact that the inset (11, 14, 53) is made of MgO.

26. Spout according to claim 1,
characterized by the fact that the inset (11, 14, 53) is made of BeO.

27. Spout according to claim 1,
characterized by the fact that the inset (11, 14, 53) is made of $ZrO_2$.

28. The ceramic spout of claim 1,
said longitudinal expansion means being a transverse gap between casing and inset.

29. The ceramic spout of claim 1,
said longitudinal expansion being a free end of the inset which allows unimpeded expansion in the longitudinal direction of the inset.

30. Ceramic spout for the casting of metal melt, with an at least partial casing (10) made of material substantially unaffected by changes of temperature and an inner inset (11) made of erosion resistant, fireproof material, characterized by the fact that (a) casing (10, 14) and inset (11, 14, 53) are separated by a radial gap everywhere between their corresponding surfaces to allow for radial expansion;

(b) the gap is bigger than or identical to the maximum thermal expansion of the materials of the casing (10, 14) and the inset (11, 14, 53) in this area, when the device is in use;

(c) the inset (11, 14, 53) is made of a material, the free Gibbs enthalpy of which has a negative value effectively high enough so that the material is stable; and (d) longitudinal expansion means allowing for longitudinal expansion of the casing and substantially the entire length of the inset up to the maximum thermal expansion of the materials of the casing and inset;

the gap (26) between casing (10, 14) and inset (11, 14, 53) being at least partially filled with material (25, 27), which is combustible and very compressible under volume reduction, at temperatures below those obtained in the gap (26) when hot metal melt is passing through the spout so that said material is burned away and compressed when hot metal is poured through the spout to provide room for the casing and inset to expand toward each other, the material being adapted to burn largely without residue, preferably ash-free, the material being at least partially a thermal insulation material (25, 27) to keep the casing cooler, the inset (11) being suspended in the casing (10) by a flange (23), the inset (11, 14, 53) and the casing (10, 14) being produced in an isostatic pressing process, the casing (10, 14) being made of a fireproof, ceramic material, such as: fire-clay, alumina, alumina-graphite, amorphous silica, mullite, mullite-graphite or zirconic silicate, the inset (11, 14, 53) being made of CaO, its structural components (10, 11, 14, 53) being at least partially soaked in tar, the material (25, 27) being made of foamed plastic, and the material (25, 27) being inserted onto the inset (11) in the shape of rings, completely filling the gap (26), and further including a suitable plug (60), the plug consisting in its entirety of CaO.

* * * * *